US010294021B2

(12) United States Patent
Ni et al.

(10) Patent No.: US 10,294,021 B2
(45) Date of Patent: May 21, 2019

(54) FAST UNLOADING FOLDING CARGO CONTAINER

(71) Applicants: Zhoumin Ni, New York, NY (US); Guangwei Wang, Fijan (CN)

(72) Inventors: Zhoumin Ni, New York, NY (US); Guangwei Wang, Fijan (CN)

( * ) Notice: Subject to any disclaimer, the term of this patent is extended or adjusted under 35 U.S.C. 154(b) by 100 days.

(21) Appl. No.: 15/619,206

(22) Filed: Jun. 9, 2017

(65) Prior Publication Data

US 2017/0369234 A1 Dec. 28, 2017

(30) Foreign Application Priority Data

Jun. 22, 2016 (CN) ..... 2016 2 0626087 U

(51) Int. Cl.

| | |
|---|---|
| ***B65G 9/00*** | (2006.01) |
| ***B65D 88/52*** | (2006.01) |
| ***B65D 81/05*** | (2006.01) |
| ***B65D 88/54*** | (2006.01) |
| ***B65D 90/08*** | (2006.01) |
| ***B65D 90/00*** | (2006.01) |

(52) U.S. Cl.

CPC ..... *B65D 88/522* (2013.01); *B65D 81/05* (2013.01); *B65D 88/54* (2013.01); *B65D 90/008* (2013.01); *B65D 90/08* (2013.01)

(58) Field of Classification Search

CPC ..... B65D 88/522; B65D 88/54; B65D 88/12; B65D 88/52; B65D 81/05; B65D 90/08; B65D 90/008; B65D 7/26; B65D 7/14; B65D 7/24; B65D 9/18

USPC ..... 220/485, 6, 4.28, 1.5, 9.1, 9.2, 9.3, 7, 220/666, 668; 211/195; 312/108, 258, 312/262; 206/600, 386, 598

See application file for complete search history.

(56) References Cited

U.S. PATENT DOCUMENTS 3,329,281 A * 7/1967 Ball ..... F25D 25/02 211/153

4,595,106 A * 6/1986 Kunze ..... B65G 9/002 211/118

* cited by examiner

*Primary Examiner* — Fenn C Mathew
*Assistant Examiner* — Elizabeth J Volz
(74) *Attorney, Agent, or Firm* — Weitzman Law Offices, LLC

(57) ABSTRACT

A fast unloading folding cargo container has a left frame, a right frame, a rear frame, a bottom frame, and connection members. The left frame and the right frame are rotatably connected to the rear frame via the connection members. Both ends of the bottom frame are formed with locking slots that lock onto the rails on the bottoms of the left frame and the right frame, both sides of the bottoms of the left frame and the right frame include recessed support grooves, and the left frame and the right frame both include a suspension member on the top.

20 Claims, 2 Drawing Sheets

FAST UNLOADING FOLDING CARGO CONTAINER

FIELD OF THE INVENTION

This disclosure relates generally to containers and, more particularly, to cargo containers.

BACKGROUND

During a production process, a production workshop requires transport of a variety of raw materials, semi-finished products and finished products, and therefore uses warehouse carts and cargo containers. However, existing cargo containers can only be transported using warehouse carts, not by forklifts or cranes, which leads to a poor universal applicability. Moreover, those cargo containers cannot be folded, which leads to them taking up a large occupied space and makes for inconvenient unloading.

SUMMARY

We have developed a cargo container design a that can be transported by a variety of transport devices, has a simple structure, occupies a small space, and facilitates unloading. Embodiments of our design can provide the at least some of the following advantages. Since two sides of the bottoms of the left frame and the right frame are all formed with recessed support grooves, this enables transport of the cargo container by means of a forklift, a dolly and the like, leading to strong universal applicability. With some embodiments, the left frame and the right frame include a suspension ring on the top, which enables the transport of the cargo container using a crane, also leading to strong universal applicability. During unloading, the cargo container is place-able on the unloading rack so that the unloading rack supports the goods, within the cargo container. The left frame and the right frame can ten be rotated around the rear frame to open the cargo container up and, thereby, facilitates unloading. In addition, by virtue of this folding capability, when not in use, the left frame, right frame and rear frame can be folded together to greatly reduce the occupied space and facilitate the recovery of the cargo container.

One aspect of this disclosure involves a fast unloading folding cargo container having a left frame, a right frame, a rear frame, a bottom frame, and connection members. The left frame and the right frame are rotatably connected to the rear frame via the connection members. Both ends of the bottom frame are formed with locking slots that lock onto the rails on the bottoms of the left frame and the right frame, both sides of the bottoms of the left frame and the right frame include recessed support grooves, and the left frame and the right frame both include a suspension member on the top.

Other aspects of the disclosure involve the left frame, the right frame and the rear frame all having a rectangular outer frame and a number of frame support rails within the rectangular outer frame, and the bottom frame having bottom bars, and a number of base support rails, spaced apart from each other, on the bottom bars.

Still other aspects of the disclosure involve an unloading rack including base bars and a number of loading rails located on the base bars, so that the loading rails correspond to the spacing between the support rails.

Additional aspects of the disclosure involve a cushion layer on top of the loading rails.

Still further aspects of the disclosure involve a front rung, with one end of the front rung rotatably connected to one of the left frame or the right frame, and the other of the left frame or right frame is provided with a locking member to which the front rung can lock.

Yet other aspects of the disclosure involve the locking member being one of a hook or a latch.

Further aspects of the disclosure involve the connection member being at least one of a hinge or a shaft.

Finally, some aspects of the disclosure involve the suspension member being a suspension ring or a hook.

The foregoing and following outlines rather generally the features and technical advantages of one or more embodiments of this disclosure in order that the following detailed description may be better understood. Additional features and advantages of this disclosure will be described hereinafter, which may form the subject of the claims of this application.

BRIEF DESCRIPTION OF THE DRAWINGS

This disclosure is further described in the detailed description that follows, with reference to the drawings, in which.

DETAILED DESCRIPTION

Specific examples of our fast unloading folding cargo container will now be described with reference to the accompanying drawings. It should be apparent that the described examples are only representative of a few, not all, of the embodiments that can be created based upon this disclosure. All other embodiments that can be created by those skilled in the art based on the examples herein are intended to be encompassed by the present disclosure.

Figure 1:
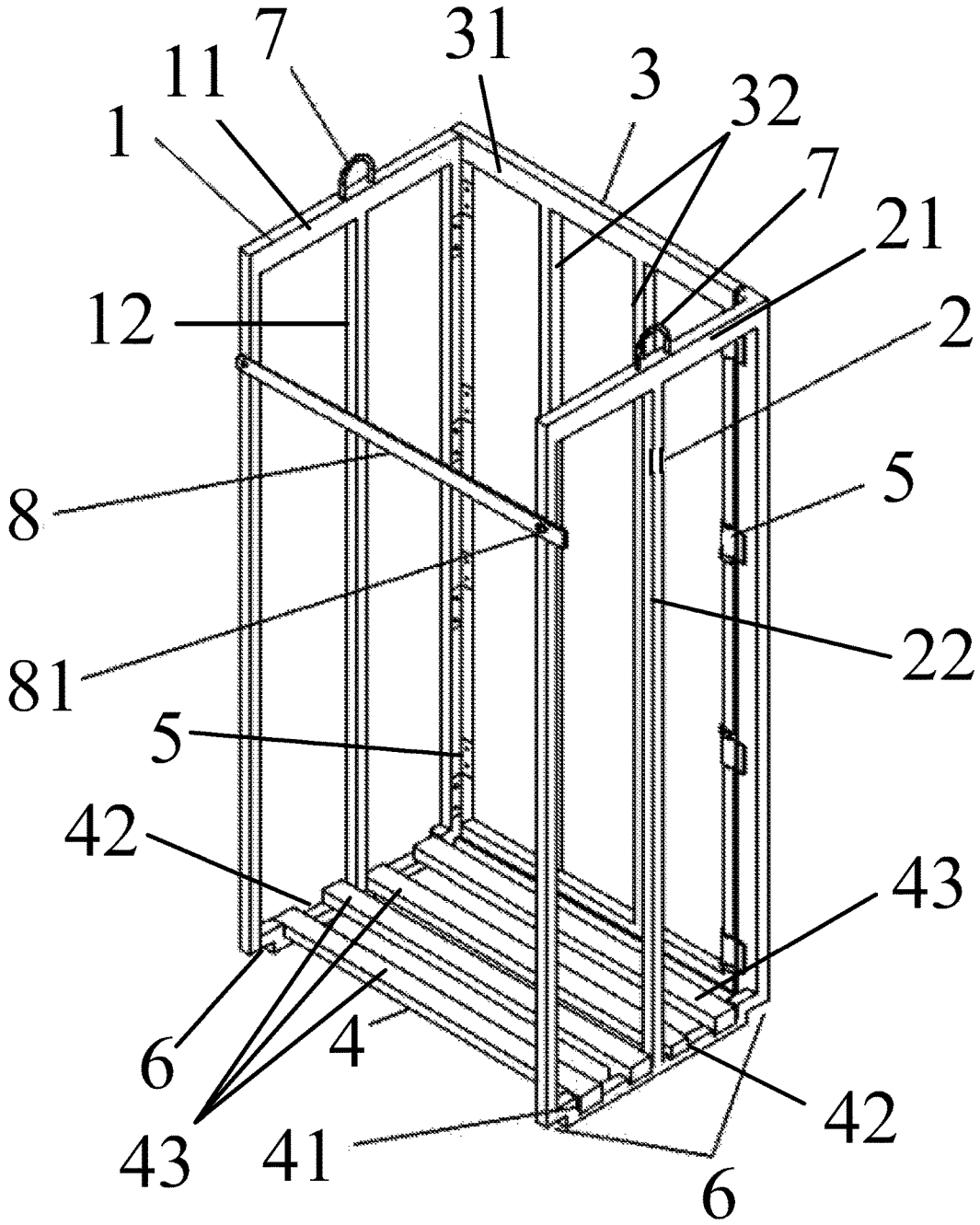
FIG. 1 illustrates, in simplified form, a schematic view of the structure of a fast unloading folding cargo container as described herein.
Figure 2:
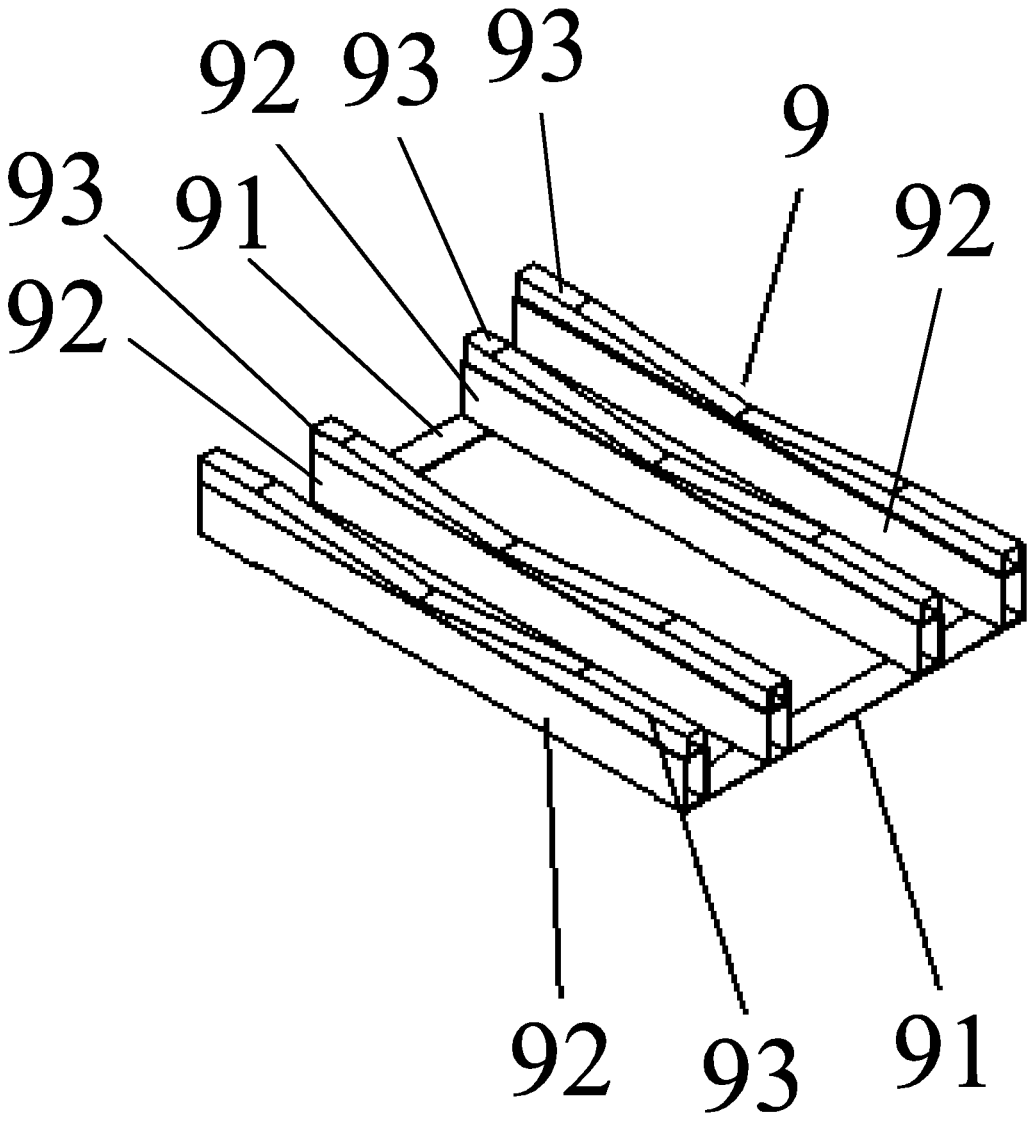
FIG. 2 illustrates, in simplified form, schematic view of the structure of the unloading rack for the fast unloading folding cargo container of FIG. 1.

Referring to FIG. 1 and FIG. 2, the fast unloading folding cargo container comprises a left frame 1, a right frame 2, a rear frame 3, a bottom frame 4, and connection members 5. The left frame 1 and the right frame 2 are rotatably connected to the rear frame 3 via the connection members 5. The connection members 5 may be one or more hinges, shafts or other connection devices.

Two ends of the bottom frame 4 are formed with locking slots 41. The locking slots 41 lock onto the rails on the bottoms of the left frame 1 and the right frame 2. Two sides of the bottoms of the left frame 1 and the right frame 2 are all formed with recessed support grooves 6. The left frame 1 and the right frame 2 include at least one suspension member 7 on the top for lifting. The suspension member may be a suspension ring or a hook, or may be other structures.

Preferably, the cargo container further comprises a front rung 8. As shown, one end of the front rung 8 is rotatably connected to the left frame 1. The right frame 2 includes a locking member 81 for locking the front rung 8 to the right frame 2. The locking member 81 may be a hook, a latch or the like. The provision of the front rung 8 blocks the goods to prevent the goods from falling out. One, two, three or more front rungs 8 may be provided as needed to secure the goods the cargo container will contain. In addition, any one or all of the front rungs 8 can alternatively be rotatably connected to the right frame 2, in which case the corresponding part of the left frame 1 would include the locking member 81.

Ideally, the left frame 1, the right frame 2 and the rear frame 3 are all rectangular and respectively each comprise and outer frame 11, 21, 31 and a number of frame support rails 12, 22, 32 located inside the respective rectangular outer frames 11, 21, 31. The bottom frame 4 comprises bottom bars 42 and a number of base support rails 43 located on the bottom bars 42 at spaced intervals.

The cargo container further comprises an unloading rack 9. The unloading rack comprises base bars 91 and a number of loading rails 92 disposed on the base bars 91, and loading rails 92 spaced apart so as to correspond to the space between the base support rails 43.

Ideally, a cushion layer 93 on the top of the loading rails 92 acts as a buffer for loaded cargo.

As shown, the two sides of the bottoms of the left frame 1 and the right frame 2 are all formed with recessed support grooves 6. The support grooves 6 enable transport of the cargo container by means of a forklift, a dolly and the like, yielding strong universal applicability. In addition, as shown, the left frame 1 and the right frame 2 are both provided with a suspension ring 7 on the top, which enables the transport of the cargo container by means of a crane, also yielding strong universal applicability. During unloading, the cargo container is placed on the unloading rack 9 so that the unloading rack 9 supports goods. Then, the left frame 1 and the right frame 2 can be rotated around behind the rear frame 3 to open the cargo container up, which facilitates the unloading. Likewise, when not in use, the left frame 1, the right frame 2 and the rear frame 3 can be folded together to greatly reduce the space occupied by the cargo container and to facilitate the recovery of the cargo container.

Having described and illustrated the principles of this application by reference to one or more example embodiments, it should be apparent that the embodiment(s) may be modified in arrangement and detail without departing from the principles disclosed herein and that it is intended that the application be construed as including all such modifications and variations insofar as they come within the spirit and scope of the subject matter disclosed.

What is claimed is:

1. A fast unloading folding cargo container comprising:

a left frame, a right frame, a rear frame, a bottom frame, and connection members, the left frame and the right frame are rotatably connected to the rear frame via the connection members, both ends of the bottom frame are formed with locking slots that lock onto bottoms of the left frame and the right frame, both sides of the bottoms of the left frame and the right frame include recessed support grooves, and the left frame and the right frame both include a suspension member on the top.

2. The fast unloading folding cargo container of claim 1, wherein:

the left frame, the right frame and the rear frame all comprise a rectangular outer frame and a number of frame support rails within the rectangular outer frame, and the bottom frame comprises bottom bars and a number of base support rails, spaced apart from each other, on the bottom bars.

3. The fast unloading folding cargo container of claim 2, further comprising:

an unloading rack including base bars and a number of loading rails located on the base bars, so that the loading rails correspond to the spacing between the support rails.

4. The fast unloading folding cargo container of claim 3, further comprising:

a cushion layer on top of the loading rails.

5. The fast unloading folding cargo container of claim 1, further comprising:

a front rung, with one end of the front rung rotatably connected to one of the left frame or the right frame, and the other of the left frame or right frame is provided with a locking member to which the front rung can lock.

6. The fast unloading folding cargo container of claim 5, wherein:

the left frame, the right frame and the rear frame all comprise a rectangular outer frame and a number of frame support rails within the rectangular outer frame, and the bottom frame comprises bottom bars and a number of base support rails, spaced apart from each other, on the bottom bars.

7. The fast unloading folding cargo container of claim 6, further comprising:

an unloading rack including base bars and a number of loading rails located on the base bars, so that the loading rails correspond to the spacing between the support rails.

8. The fast unloading folding cargo container of claim 7, further comprising:

a cushion layer on top of the loading rails.

9. The fast unloading folding cargo container of claim 5, wherein the locking member is one of a hook or a latch.

10. The fast unloading folding cargo container of claim 9, wherein:

the left frame, the right frame and the rear frame all comprise a rectangular outer frame and a number of frame support rails within the rectangular outer frame, and the bottom frame comprises bottom bars and a number of base support rails, spaced apart from each other, on the bottom bars.

11. The fast unloading folding cargo container of claim 10, further comprising:

an unloading rack including base bars and a number of loading rails located on the base bars, so that the loading rails correspond to the spacing between the support rails.

12. The fast unloading folding cargo container of claim 11, further comprising:

a cushion layer on top of the loading rails.

13. The fast unloading folding cargo container of claim 1, wherein the connection member is at least one of a hinge or a shaft.

14. The fast unloading folding cargo container of claim 13, wherein:

the left frame, the right frame and the rear frame all comprise a rectangular outer frame and a number of frame support rails within the rectangular outer frame, and the bottom frame comprises bottom bars and a number of base support rails, spaced apart from each other, on the bottom bars.

15. The fast unloading folding cargo container of claim 14, further comprising:

an unloading rack including base bars and a number of loading rails located on the base bars, so that the loading rails correspond to the spacing between the support rails.

16. The fast unloading folding cargo container of claim 15, further comprising:

a cushion layer on top of the loading rails.

17. The fast unloading folding cargo container of claim 1, wherein the suspension member is a suspension ring or a hook.

18. The fast unloading folding cargo container of claim 17, wherein:

the left frame, the right frame and the rear frame all comprise a rectangular outer frame and a number of frame support rails within the rectangular outer frame, and the bottom frame comprises bottom bars and a number of base support rails, spaced apart from each other, on the bottom bars.

19. The fast unloading folding cargo container of claim 18, further comprising:

an unloading rack including base bars and a number of loading rails located on the base bars, so that the loading rails correspond to the spacing between the support rails.

20. The fast unloading folding cargo container of claim 19, further comprising:

a cushion layer on top of the loading rails.

* * * * *